United States Patent [19]

Geslewitz

[11] Patent Number: 4,802,259

[45] Date of Patent: Feb. 7, 1989

[54] SPATTER SHIELD

[76] Inventor: Daniel G. Geslewitz, 8014 E. Del Tesoro, Scottsdale, Ariz. 85261

[21] Appl. No.: 28,216

[22] Filed: Mar. 20, 1987

[51] Int. Cl.[4] ..... E05D 11/00

[52] U.S. Cl. ..... 16/251

[58] Field of Search ..... 16/250, 251

[56] References Cited

U.S. PATENT DOCUMENTS

| | | | |
|---|---|---|---|
| 1,199,409 | 9/1916 | Neuberth | 16/250 |
| 2,023,249 | 12/1935 | Soss | 16/251 |
| 2,169,059 | 8/1939 | Soss et al. | 16/251 |
| 2,274,160 | 2/1942 | Porter | 16/251 |
| 2,342,453 | 2/1944 | Colucci | 16/250 |
| 4,040,142 | 8/1977 | Ippolito | 16/251 |
| 4,570,291 | 2/1986 | Smith et al. | 16/250 |

*Primary Examiner*—Fred A. Silverberg

*Attorney, Agent, or Firm*—Don J. Flickinger; Jordan M. Meschkow

[57] ABSTRACT

A panel for overlaying the exposed surface of the leaf of a hinge component has an edge contoured to align with the edge of the leaf. A longitudinally served tubular member extending along an edge of the panel receives the pintle portion of the hinge component. The pintle portion may be compressively quipped within the tubular member. Also, a pressure sensitive adhesive may be carried on the surface of the panel for application to the surface of the leaf.

6 Claims, 1 Drawing Sheet

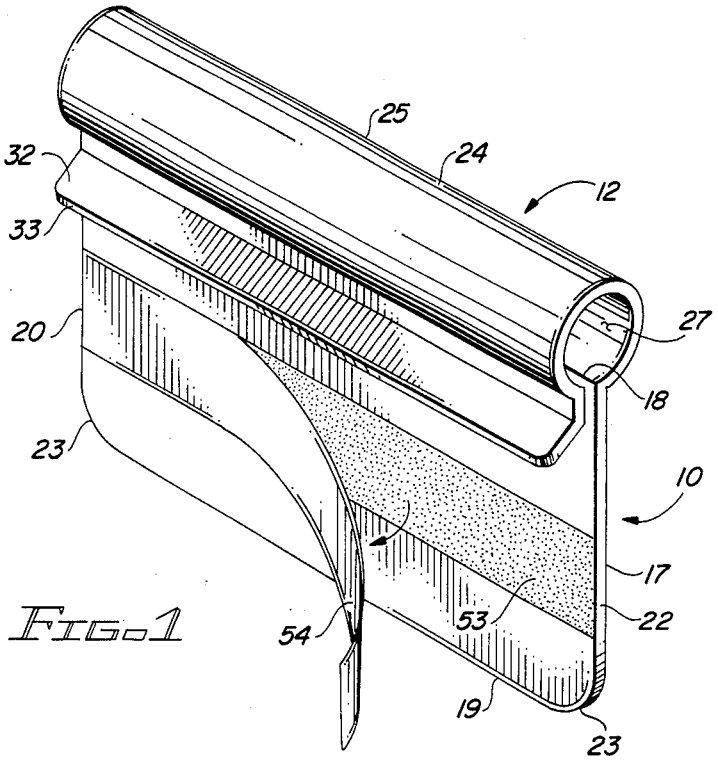
FIG. 1
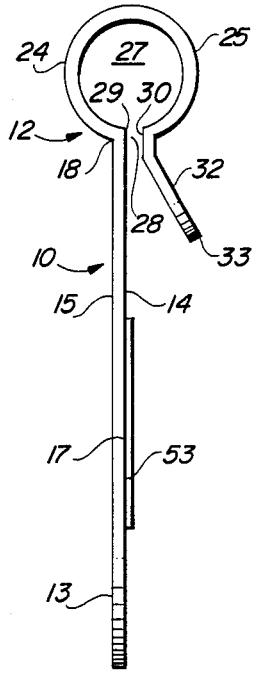
FIG. 2
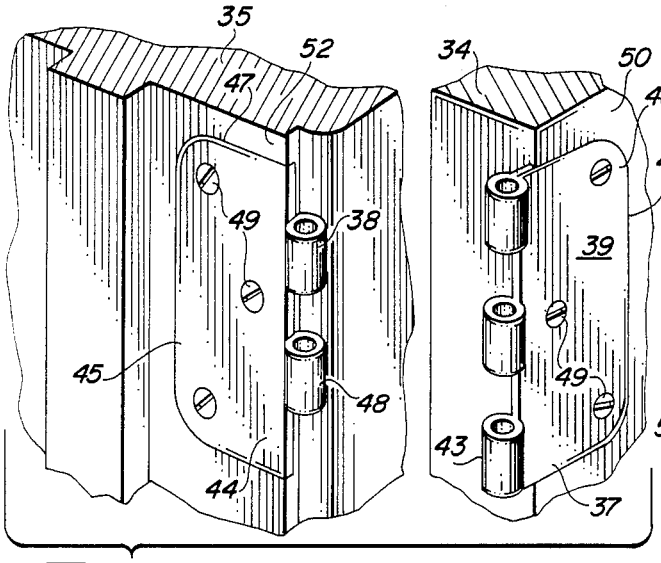
FIG. 3
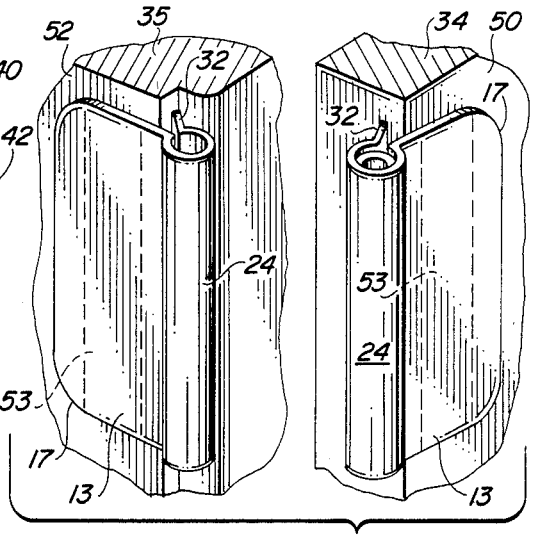
FIG. 4
FIG. 5
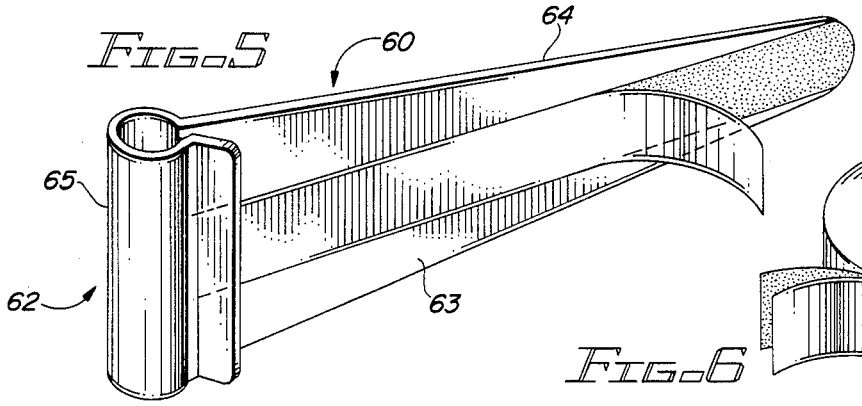
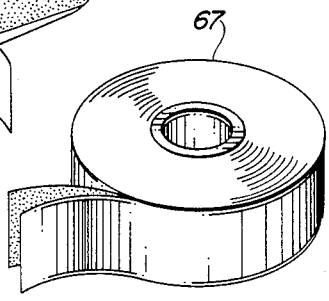
FIG. 6

SPATTER SHIELD

BACKGROUND OF THE INVENTION

1. Field of the Invention

This invention relates to spatter shields.

More particularly, the present invention relates to shields for masking a selected surface while a treatment is applied to an adjacent surface.

In a further and more particular aspect, the instant invention concerns a shield of the above character which is especially adapted for use in connection with conventional hinges.

2. The Prior Art

For purposes of restoration and maintenance, it is conventional practice to periodically apply a liquid treatment to a surface. Exemplary is the application of finishing material such as stain, paint, varnish or other protective coatings. Also common are various surface preparation and conditioning mediums such as finish removers and sizing compounds.

Frequently, the surface to be treated is a portion of a structure to which a substructure is attached. Notable are cover plates used on wall mounted outlets and hinges for affixing a door to a jamb. For obvious reasons it is desirable to limit the application of the treatment to the surface of the main or environmental structure. Accordingly, it is necessary to protect the surface of the substructure from spatter as liquid is applied, usually by brush or spray gun, to the adjacent or surrounding surface.

Certain substructures, such as the previously noted cover plates, are readily and conveniently removable from the environment without special tools or skills. Other substructures, such as hinges, require considerable effort for removal and replacement. The effort represents burdensome additional time for the professional tradesman and may exceed the ability of the do-it-yourselfer. Therefore, it has become common practice to mask the surface of hinges and other items which are considered to be permanently attached, while the surrounding surface is painted or otherwise treated.

Masking generally assumes the use of tape and paper. Although not as laborious as removing the substructure, masking the surface thereof is indeed a time consuming and tedious task. The tape must be cut to correspond to the contour of the surface to be protected and carefully applied so as to not to overlap the surface to be treated. After the primary task is completed, removal and disposal of the masking material must be undertaken. The undertaking is generally drearisome and messy.

It would be highly advantageous, therefore, to remedy the foregoing and other deficiencies inherent in the prior art as pertains to certain substructures.

SUMMARY OF THE INVENTION

Accordingly, it is an object of the present invention to provide improvements to expedite the application of liquid treatments to surfaces having substructures affixed thereto.

Another object of the invention is the provision of improved means for protecting a hinge while paint or other liquid is applied to the surrounding surface.

And another object of this invention is to provide a spatter shield especially adapted for use in connection with hinge components.

Still another object of the invention is the provision of a spatter shield which will materially reduce the time required to attend to the maintenance of doors and doorjambs.

Yet another object of the instant invention is to provide a spatter shield which is easily and conveniently installed and removed.

Yet still another object of the invention is to provide a masking device which will overlay the surface and correspond with the contour of the edge of the leaf of a hinge.

And a further object of the immediate invention is the provision of a spatter shield having ameliorated means for attachment.

Yet a further object of the invention is to provide a device that is readily manufacturable in shapes and sizes to accommodate the array of conventional commercially available hinge configurations.

Still a further object of the invention is the provision of a spatter shield which is comparatively inexpensive and yet reusable.

And yet a further object of the invention is to provide a device according to the foregoing which may be manufactured of various materials in accordance with conventional techniques.

Briefly, to achieve the desired objects of the instant invention in accordance with a preferred embodiment thereof, provided is a cover for overlaying the exposed surface of the leaf of a hinge component. Also provided are attachment means for securing the cover to the hinge component. In a more specific embodiment, the cover is in the form of a generally rigid panel having a surface for lying in juxtaposition with the exposed surface of the leaf and an edge contoured to substantially align with the edge of the leaf.

Preferred attachment means includes coupling means detachably engageable with the pintle portion of the hinge component. The coupling means may be in the form of a generally tubular member having a bore for receiving the pintle portion therein. In a more specific configuration, the tubular member is severed longitudinally to define an elastically expansive bore for frictionally receiving the pintle portion of the component. The attachment means may also include pressure sensitive adhesive carried by the surface of the panel for application to the exposed surface of the leaf.

BRIEF DESCRIPTION OF THE DRAWINGS

The foregoing and further and more specific objects and advantages of the instant invention will readily occur to those skilled in the art from the following detailed description of preferred embodiments thereof taken in conjunction with the drawings in which:

FIG. 1 is a perspective view of a spatter shield embodying the principals of the instant invention;

FIG. 2, is an end elevation view, on an enlarged scale, of the embodiment of FIG. 1;

FIG. 3 is an exploded fragmentary view of a conventional butt hinge as it would appear when attached to a door and the supporting doorjamb;

FIG. 4 is a view generally similar to the view of FIG. 3 as the hinge components would appear when having the spatter shield of FIG. 1 affixed thereto;

FIG. 5 is a perspective view of an alternate spatter shield constructed in accordance with the teachings of the instant invention; and FIG. 6 is a perspective view of a roll of adhesive material of the type useful in connection with the instant invention.

DETAILED DESCRIPTION OF THE PREFERRED EMBODIMENTS

Turning now to the drawings in which like reference characters indicate the corresponding elements throughout the several views, attention is first directed to FIG. 1 which illustrates a spatter shield of the instant invention including a cover portion generally designated by the reference character 10 and an attachment portion generally designated by the reference character 11. In the embodiment herein chosen for purposes of illustration, cover portion 10, as seen with further reference to FIG. 2, includes a relatively thin rigid panel 13 having opposed sides 14 and 15, each defined by a substantially planar surface. Edge 17, extending continuously about panel 10, is a composite of several sub-edges including longitudinal edges 18 and 19 and lateral edges 20 and 22.

For purposes of orientation in connection with the ensuing description, sides 14 and 15 are considered to be the inner and outer surfaces, respectively. Similarly, longitudinal edge 18 is designated as the attachment edge while longitudinal edge 19 becomes the free edge. It is noted that the juncture of each lateral edge 20 and 22 with free edge 19 is radiused to form curved portions 23. An appreciation of the size and shape of panel 13 will be had as the description ensues.

In accordance with the immediately preferred embodiment of the invention, attachment portion 12 includes elongate tubular member 24 having external surface 25 and longitudinal bore 27. Tubular member 24 is severed longitudinally by slit 28 which is bounded by edges 29 and 30. Edge 29, the fixed edge, is coincident with the attachment edge 18 of panel 13. Tab 32, terminating with longitudinally extending free end 33, projects from edge 30 generally radially outward from tubular member 24.

For proper application of paint or other surface treatment, it is generally recommended that the door be removed from the jamb in a relatively simple procedure. Also, it is common practice to apply the selected surface finish after the hinge components are installed butt prior to assembly of the door with the jamb. With reference to FIG. 3, there is seen a fragmentary portion of a door 34 and of a door jamb 35, the environmental structures to which are attached hinge components 37 and 38, respectively. As will be appreciated by those skilled in the art, hinge component 37 includes leaf 39 having exposed surface 0 and edge 42. A segmented generally cylindrical pintle portion 43 projects from edge 42. Similarly, hinge component 38 includes leaf 44 having exposed surface 45 and edge 47 from which projects segmented pintle portion 48. As illustrated, the door is separated from the jamb. When assembled, the segments of pintle portion 48 reside intermediate the segments of pintle portion 43 and are pivotally joined by a pin extending through the several segments.

In accordance with conventional technique, each leaf resides within a correspondingly shaped recess and is affixed to the respective environmental structure by means of screws 49. Typically, the screws are of the flat head type, the heads being received in countersunk bores to provide continuity to the generally planar exposed surface of the leaf. As a result of the attachment technique, the exposed surface 40 of hinge component 37 resides in the same plane as the surrounding surface 50 of environmental member 34. Similarly, exposed surface 45 of leaf 44 is generally continuous with the surrounding surface 52 of jamb 35.

Typically, door 34 and jamb 35 are fabricated of wood which require the periodic application of a liquid treatment for purposes of esthetics, maintenance or restoration. Hinge components 37 and 38 are usually manufactured of metal, such as brass or chrome plated steel, having a maintenance-free surface. The spatter shield of the instant invention provides protection for the exposed surfaces of the hinge components while paint, varnish or other liquid is applied to the surrounding surface.

As seen with reference to FIG. 4, the pintle portions 43 and 48 of the respective hinge components are received within the bore 27 of tubular member 24. Panel 13 extends therefrom to overlay the exposed surface of the respective leaf. Edge 17 of the spatter shield is contoured to coincide with the edge of the respective hinge component. Tab 32 functions as an abutment member to bear against a portion of the exposed surface to urge the surface 14 of the spatter shield against the respective surface 39 or 44 of the hinge component.

Preferably, the spatter shield is an integral or homogeneous structure of a material selected to be substantially rigid yet have inherent resilient qualities. Examples of such materials include sheet metal and plastics. Bore 27 is sized to frictionally receive and engage the respective pintle portion. It is apparent, therefore, that tubular member 24 holds the spatter shield in engagement with the hinge component while tab 32 urges the panel in juxtaposition with the surface of the leaf.

Further attachment means for holding the surface 14 of panel 13 in juxtaposition with the exposed surface of the leaf of the hinge component are also contemplated by the instant invention. With additional reference to FIGS. 1 and 2, there is seen a strip of pressure sensitive adhesive 53 is carried on surface 14 of panel 13. Protective strip 54 normally overlays pressure sensitive adhesive 53 during stowage. Strip 54 is optionally removable prior to the use of the spatter shield. With strip 54 removed, adhesive 53 is applied to the exposed surface of the hinge component by the application of pressure to surface 17 of panel 13. The adhesive bond assists in holding the surfaces in juxtaposition.

FIG. 5 illustrates an alternate embodiment of the invention including cover portion 60 and attachment portion 62. Cover portion 60 includes panel 63 having peripheral edge 64 while attachment portion 62 includes tubular member 65. In all respects not specifically otherwise described, the structure and function of the immediate embodiment is analogous to the structure and function of the previously described embodiment. The immediate embodiment differs in the shape of panel 63 which is determined by the contour of edge 64.

The embodiment of FIG. 1 is especially devised for use in combination with the type of hinge commonly referred to as a butt hinge. While having generally rectangular shaped leaves, butt hinges are subject to variation in size and finite shape. For example, the immediate embodiment is shaped to overlay a butt hinge in which the leaves include rounded corners. It will be appreciated that the device may be readily modified to accommodate butt hinges having square corners. The embodiment of FIG. 5 is set forth for the specific purpose of disclosing a spatter shield constructed in accordance with the teachings of the instant invention may be alternately configured to accommodate alternate types of hinges. Chosen for purposes of illustration in FIG. 5 is a spatter shield adapted for use in connection with a hinge of the type commonly referred to as a strap hinge. Other configurations will readily occur to those skilled in the art.

Adhesive 53 is subject to deterioration as a result of use. An adhesive which is rendered unusable, may be quickly and conveniently removed with a selected solvent. Subsequently, adhesive may be reapplied from a roll of commercially available double-sided adhesive such as roll 67 illustrated in FIG. 6.

Various and modifications and variations to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described and disclosed the instant invention in such clear and concise terms as to enable those skilled in the art to understand and practice the same, the invention claimed is:

1. A shield for use in combination with a hinge component, said hinge component including a leaf having an exposed surface and an edge with a defined contour, and a generally cylindrical pintle portion projecting from said surface, said leaf being affixed to an environmental structure having a surrounding surface, and for protecting said hinge component during application of a treatment to said surrounding surface, said sheild comprising:

(a) a cover for overlaying the exposed surface of said leaf, said cover including a generally rigid panel having a surface for lying in juxtaposition with the exposed surface of said leaf and an edge of said leaf;

(b) attachment means for detachably securing said cover to said hinge component, said attachment means comprising a generally tubular member extending along a portion of the edge of said panel and having a bore for receiving said pintle portion therein; and (c) a short tab extending generally radially from said tubular member in the same direction as the panel and at an acute angle to said panel for bearing against said environmental member and urging potential rotational movement of said tubular member about said pintle portion to urge the surface of said panel against the exposed surface of said leaf.

2. The shield of claim 1, wherein said attachment means further includes a pressure sensitive adhesive carried by said cover for application to the exposed surface of said leaf.

3. The shield of claim 1, wherein said tubular member and said panel are integrally joined.

4. The shield of claim 3, wherein said tubular member and said panel are homogeneously molded of a synthetic resin.

5. The shield of claim 3, wherein said tubular member and said panel are formed of a single piece of sheet metal.

6. The shield of claim 1, wherein said tubular member is severed longitudinally to define an elastically expansive bore for frictionally receiving the pintle portion of said hinge component.

* * * * *